United States Patent [19]

Shibuya

[11] 4,094,617

[45] June 13, 1978

[54] AUTOMOTIVE AIR CONDITIONER COMPRESSOR

[75] Inventor: Tsunenori Shibuya, Konan, Japan

[73] Assignee: Diesel Kiki Co., Ltd., Tokyo, Japan

[21] Appl. No.: 738,203

[22] Filed: Nov. 3, 1976

[30] Foreign Application Priority Data

Nov. 10, 1975 Japan ..... 50/152645

[51] Int. Cl.[2] ..... F04R 49/00; F25B 27/00

[52] U.S. Cl. ..... 417/295; 417/505; 62/230; 62/323

[58] Field of Search ..... 417/293, 295, 294, 505, 417/420, 298; 62/323, 230

[56] References Cited

U.S. PATENT DOCUMENTS

| | | | |
|---|---|---|---|
| 1,475,757 | 11/1963 | Dyson | 417/294 |
| 1,884,702 | 10/1932 | Hubacker | 417/294 |
| 2,302,847 | 11/1942 | Ferguson | 417/295 |
| 2,318,893 | 5/1943 | Smith | 62/323 X |
| 2,961,147 | 11/1960 | Osterkamp | 417/295 X |
| 3,671,148 | 6/1972 | Reeve | 417/295 |
| 3,941,517 | 3/1976 | Miyahara | 417/420 |
| 4,013,384 | 3/1977 | Oikawa | 417/420 |

*Primary Examiner*—William L. Freeh
*Assistant Examiner*—R. E. Gluck
*Attorney, Agent, or Firm*—Frank J. Jordan

[57] ABSTRACT

A magnet is fixed to a rotor shaft and a ferromagnetic cup which is magnetically coupled to the magnet is urged opposite to the direction of rotation of the rotor shaft by a spring. An occluder plate is fixed to the cup and is movable into alignment with a fluid inlet to block the same. As the speed of the automobile and thereby the compressor rotor shaft speed increase the magnetic fields resulting from eddy currents induced by the magnet in the cup increase and the degree of magnetic coupling thereby increases so that the cup is rotated further against the force of the spring causing the occluder plate to block the inlet to a greater extent so that the compressor output and thereby the cooling effect of the air conditioner are maintained at a substantially constant value.

9 Claims, 6 Drawing Figures

AUTOMOTIVE AIR CONDITIONER COMPRESSOR

BACKGROUND OF THE INVENTION

The present invention relates to an improvement in automobile air conditioner compressors of the rotary type which maintains the output of the compressor and thereby the cooling effect of the air conditioner substantially constant regardless of the speed at which the automobile is driven.

A typical automotive air conditioning system comprises a compressor having a rotor connected to the engine crankshaft by means of a drive belt and an electromagnetic clutch in such a manner that the rotor is driven by the engine when the electromagnetic clutch is engaged. The compressor compresses a refrigerant fluid and discharges the fluid from an outlet thereof into a condenser so that the fluid liquifies giving off latent heat of vaporization.

From the condenser the fluid is introduced through an expansion valve into an evaporator disposed in a passenger compartment of the automobile in which the fluid vaporizes thereby absorbing latent heat of vaporization from the air in the passenger compartment. A blower is typically provided to circulate the cooled air through the passenger compartment. From the evaporator the fluid is fed to an inlet of the compressor.

Since the compressor is driven from the automobile engine, the output of the compressor and thereby the cooling effect of the air conditioner will increase as the automobile is driven faster. It is common practice to design the compressor to provide optimum output at the most common driving speed, for example 45mph, so that at significantly higher speeds the passenger compartment will become too cold. Conversely, the air conditioner will cool the passenger compartment insufficiently when the automobile is stopped at a stoplight and the engine is idling, a condition in which the air conditioner is needed most.

Several expedients have been proposed in the prior art to prevent excessive cooling at high speed, the basis of most of them being to disengage the electromagnetic clutch and thereby disconnect the compressor from the engine when the cooling effect becomes too great. To this end, a sensor is provided which is responsive to the temperature in the passenger compartment or the engine speed to disengage the electromagnetic clutch when the sensed parameter exceeds a predetermined value. However, the pressure difference between the inlet and outlet of the compressor remains high for a substantial period of time after the compressor is stopped and if the compressor is restarted quickly it may be damaged and/or the engine may be subjected to a detrimental overload.

For this reason, a timer has been provided to prevent the compressor from being reconnected until the pressures at the inlet and outlet have had sufficient time to equalize. Another drawback of this system is that the temperature control may not be maintained with close tolerance since a substantial amount of hysterisis must be introduced into the system response to prevent rapid connection and disconnection of the compressor.

Another expedient which is known in the art is to provide an electromagnetically operated bypass valve connected between the compressor inlet and outlet. The valve is normally closed and is opened when the compressor is stopped to quickly equalize the pressure between the inlet and outlet. Although this valve improves the performance of the system, all systems of this type suffer from the drawback that they comprise a sensor, a control circuit, a valve etc. which complicate the overall configuration and increase the production cost of the air conditioning system and are subject to malfunction.

SUMMARY OF THE INVENTION

It is an object of the present invention to provide an improved air conditioner compressor for an automotive vehicle which provides a substantially constant cooling effect irrespective of vehicle speed.

It is another object of the present invention to provide an improved air conditioner compressor comprising a simple but effective temperature control mechanism.

It is another object of the present invention to provide an improved air conditioner compressor which reduces the number of component parts and thereby the production cost of an automotive air conditioning system.

It is another object of the present invention to provide an improved air conditioner compressor in which a magnetically driven occluder is automatically moved to block the compressor inlet as the engine speed is increased.

It is another object of the present invention to provide a generally improved automotive air conditioner compressor.

Other objects, together with the foregoing, are attained in the embodiments described in the following description and illustrated in the accompanying drawings.

DESCRIPTION OF THE PREFERRED EMBODIMENTS

While the automotive air conditioner compressor of the invention is susceptible of numerous physical embodiments, depending upon the environment and requirements of use, substantial numbers of the herein shown and described embodiments have been made, tested and used, and all have performed in an eminently satisfactory manner.

Figure 1:
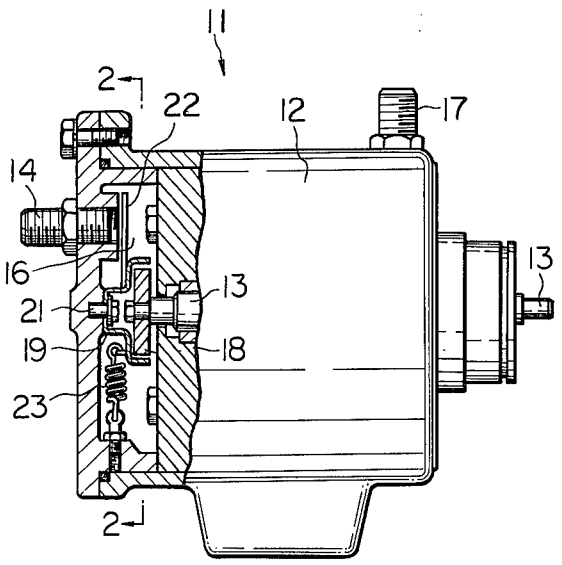
FIG. 1 is a side elevation, partly in section, of an automotive air conditioner compressor embodying the improvement of the present invention.
Figure 2:
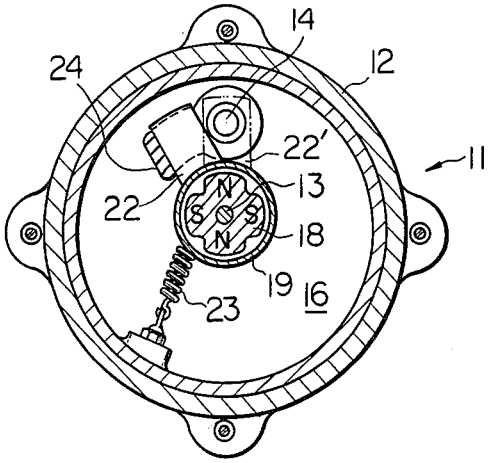
FIG. 2 is a section on a line 2—2 in FIG. 1.

Referring now to FIGS. 1 and 2 of the drawing, a rotary compressor 11 comprises a housing 12. While the compressor 11 may assume a number of different configurations within the scope of the present invention, the housing 12 is typically formed with a bore in which a rotor is eccentrically and rotatably supported. Although the rotor itself is not the subject matter of the present invention and is not shown, it is mounted on a rotor shaft 13 and is preferably provided with a plurality of radial vanes which are likewise not shown. A refrigerant fluid inlet 14 leads into a fluid inlet chamber 16 which in turn opens into the bore of the housing 12. Similarly, a refrigerant fluid outlet 17 opens from the bore of the housing 12. The inlet 14 and outlet 17 are connected to an evaporator and a condenser respectively of an air conditioner of an automobile vehicle (not shown). The rotor shaft 13 is connected to the engine of the automobile through an electromagnetic clutch (not shown) so as to be rotatable clockwise as viewed in FIG. 2 by the engine when the clutch is engaged.

Upon clockwise rotation of the rotor shaft 13, the rotor divides the interior of the bore into a plurality of fluid chambers which increase in volume where the inlet chamber 16 communicates with the bore and decrease in volume where the outlet 17 communicates with the bore so that refrigerant fluid is compressively displaced from the inlet 14 to the outlet 17 through the inlet chamber 16 and bore. The outlet 17 may communicate with an oil sump (not designated) in such a manner that the pressure in the outlet 17 is utilized to pressurize oil in the sump to effect forced lubrication of the various component parts of the compressor 11. The basic internal construction and operation of the compressor 11 is not the subject matter of the present invention and will not be described in further detail.

The improvement to the basic compressor 11 provided by the present invention comprises a driven member in the form of a magnet 18 which is fixed to the rotor shaft 13 and formed with a plurality of poles as indicated in the drawings. Both the magnet 18 and a driven member in the form of a cup 19 are disposed in the inlet chamber 16, the cup 19 being rotatably supported about a pin 21. The cup 19 is so proportioned as to coaxially surround the magnet 18 in close radial proximity. An occluder plate 22 is fixed to and radially extends from the cup 19 and a tension spring 23 urges the cup 19 counterclockwise in FIG. 2 so that the occluder plate 22 abuts against a stop 24 when the rotor shaft 13 is stationary.

The cup 19 is formed of a ferromagnetic material such as iron so as to be magnetically coupled to the magnet 18 as will be described.

As the rotor shaft 13 is rotated thereby causing the compressor 11 to displace refrigerant fluid from the inlet 14 to the outlet 17, the magnet 18 moving relative to the cup 19 induces eddy currents in the cup 19 which give rise to magnetic fields which tend to oppose the rotation of the magnet 18. Since the magnet 18 is forcibly rotated by the engine, the repelling force of the eddy current fields urges the cup 19 to rotate clockwise against the force of the spring 23. The greater the engine speed and thereby the relative motion between the magnet 18 and cup 19, the greater the magnitude of the eddy currents and magnetic fields in the cup 19 and thereby the magnetic coupling between the magnet 18 and the cup 19. The magnetic coupling force is balanced against the force of the spring 23 so that the cup 19 will attain an equilibrium position which depends on the engine speed.

More specifically, at zero speed the spring 23 urges the cup 19 counterclockwise so that the occluder plate 22 abuts against the stop 24. In this position, the occluder plate 22 completely unblocks the inlet 14 as shown in solid line. As the rotational speed of the rotor shaft 13 and thereby the magnetic coupling force between the magnet 18 and cup 19 increases, the magnetic coupling force progressively overcomes the force of the spring 23 so that the cup 19 is progressively rotated to a more clockwise equilibrium position. Clockwise rotation of the cup 19 causes the occluder plate 22 to rotate clockwise therewith to progressively occlude or block the inlet 14 and reduce the amount of refrigerant fluid flow through the compressor 11. This has the effect of reducing the cooling effect of the air conditioning system. When the engine speed is so high that damage to the compressor 11 or condenser may result, the occluder plate 22 is moved to a position shown in phantom line and designated as 22' in which the occluder plate 22' completely blocks the inlet 14.

It will be seen that the occluder plate 22 is rotated clockwise as the engine speed is increased to progressively block the inlet 14 and reduce the cooling effect of the air conditioning system to offset the increased cooling effect caused by the increased pumping capacity of the compressor 11 at the increased speed. The stiffness and preload of the spring 23, the material and configuration of the cup 19 and the shape of the occluder plate 22 are preferably selected so that the fluid flow through the compressor 11 and thereby the cooling effect of the air conditioning system will be maintained constant regardless of engine speed. If desired, however, the preload of the spring 23 may be made high and the stiffness thereof made relatively low so that the occluder plate 22 will only be moved to block the inlet 14 when the engine speed exceeds a predetermined value above which damage to the system may result. In this case, the occluder plate 22 constitutes a safety device.

Figure 3:
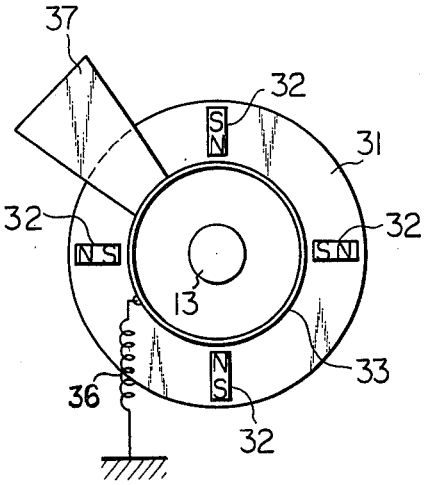
FIG. 3 is a front schematic view illustrating a modified form of the improvement.
Figure 4:
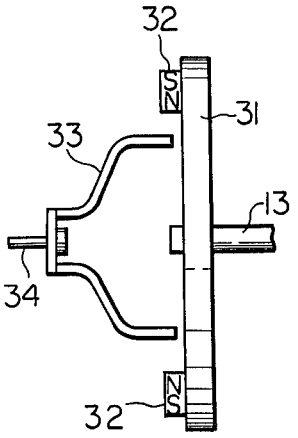
FIG. 4 is a side schematic view of the modification of FIG. 3.

A modification of the magnet 18 and the cup 19 is illustrated in FIGS. 3 and 4. The drive member in this example comprises a support disc 31 made of a nonmagnetic material which is fixed to the rotor shaft 13. Magnets 32 are fixedly mounted on the disc 31 and are radially spaced outwardly from the shaft 13 as shown. A ferromagnetic cup 33 is rotatably supported about a pin 34 and is disposed adjacent to the disc 31 in such a manner that the cup 33 is coaxially surrounded by the magnets 32. A spring 36 urges the cup 33 counterclockwise and an occluder plate 37 is fixed to the cup 33. The cup 33 is magnetically coupled to the magnets 32 and the operation of the embodiment of FIGS. 3 and 4 is essentially similar to that of FIGS. 1 and 2.

Figure 5:
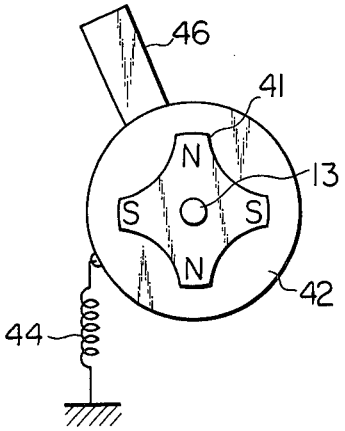
FIG. 5 is a front schematic view of another modification of the improvement.
Figure 6:
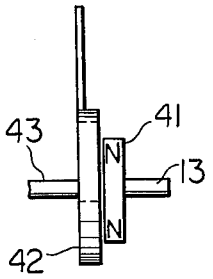
FIG. 6 is a side schematic view of the modification of FIG. 5.

FIGS. 5 and 6 illustrate another modification of the compressor 11. In this example, a magnet 41 is identical to the magnet 18 and is fixed to the shaft 13. A driven member in the form of a ferromagnetic disc 42 is rotatably supported about a pin 43. A tension spring 44 urges the disc 42 counterclockwise and an occluder plate 46 is fixed to the disc 42. The operation of this embodiment is essentially similar to the above embodiments except that the magnetic coupling between the drive and driven members is axial rather than radial.

In summary, it will be seen that the objects of the present invention are achieved since the occluder plate is automatically moved to block the inlet just enough to neutralize the increased flow rate through the compressor caused by an increase in engine speed and that an air compressor incorporating the present compressor provides a constant cooling effect regardless of engine speed. Many modifications within the scope of the invention will become possible for those skilled in the art after receiving the teachings of the present disclosure.

What is claimed is:

1. A compressor comprising:

a housing provided with an inlet and an outlet;

a rotor operatively rotatably supported within the housing to displace fluid from the inlet to the outlet upon rotation thereof; and variable occluder means connected to the rotor and operative to occlude the inlet to an extent corresponding to a rotational speed of the rotor, said occluder means comprising a drive member fixed to the rotor, a driven member yieldably connected to the drive member, biasing means urging the driven member in a direction opposite to a direction of rotation of the rotor and an occluder member fixed to the driven member and movable thereby into variable occluding relation with the inlet.

2. A compressor as in claim 1, in which the occluder means is operative to occlude the inlet to a greater extent as the rotational speed of the rotor is increased.

3. A compressor as in claim 1, in which the drive member and driven member are formed of materials so as to be magnetically yieldably coupled together.

4. A compressor as in claim 3, in which the drive member comprises a permanent magnet and the driven member is formed of a ferromagnetic material.

5. A compressor as in claim 1, further comprising a stop, the biasing means urging the occluder member toward abuting engagement with the stop, the occluder member occluding the inlet to a minimum extent when in abutment with the stop.

6. A compressor as in claim 4, in which the driven member comprises a cup coaxially surrounding the magnet.

7. A compressor as in claim 4, in which the biasing means comprises a spring.

8. A compressor as in claim 4, in which the driven member comprises a disc disposed axially closely adjacent to the magnet.

9. A compressor as in claim 4, in which the magnet is arranged radially coaxially outward of the driven member.

* * * * *